US011365590B2

(12) United States Patent
Da Silva et al.

(10) Patent No.: US 11,365,590 B2
(45) Date of Patent: Jun. 21, 2022

(54) DYNAMIC WEAR PREDICTION FOR FIXED CUTTER DRILL BITS

(71) Applicant: Halliburton Energy Services, Inc., Houston, TX (US)

(72) Inventors: Nuno Da Silva, Brussels (BE); Valerie Sillen, Brussels (BE); Stephan Regnard, Brussels (BE)

(73) Assignee: Halliburton Energy Services, Inc., Houston, TX (US)

( * ) Notice: Subject to any disclaimer, the term of this patent is extended or adjusted under 35 U.S.C. 154(b) by 829 days.

(21) Appl. No.: 16/247,788

(22) Filed: Jan. 15, 2019

(65) Prior Publication Data

US 2019/0145184 A1 May 16, 2019

Related U.S. Application Data

(63) Continuation of application No. 15/027,966, filed as application No. PCT/US2013/069187 on Nov. 8, 2013, now abandoned.

(51) Int. Cl.
*E21B 10/42* (2006.01)
*E21B 10/55* (2006.01)
(Continued)

(52) U.S. Cl.
CPC ..... *E21B 12/02* (2013.01); *E21B 10/42* (2013.01); *E21B 10/55* (2013.01); *E21B 49/003* (2013.01)

(58) Field of Classification Search
CPC ..... E21B 10/42; E21B 10/55; E21B 12/02; E21B 49/003
See application file for complete search history.

(56) References Cited

U.S. PATENT DOCUMENTS 4,627,276 A 12/1986 Burgess et al.
4,804,051 A 2/1989 Ho
(Continued)

FOREIGN PATENT DOCUMENTS

EP 0308327 A1 3/1989
EP 0336477 A1 3/1989
(Continued)

OTHER PUBLICATIONS

International Search Report and Written Opinion, Application No. PCT/US2013/069187; 17 pages.

*Primary Examiner* — Daniel P Stephenson
(74) *Attorney, Agent, or Firm* — Delizio, Peacock, Lewin & Guerra

(57) ABSTRACT

An example method for dynamic wear prediction for a drill bit with a cutting structure may include receiving at a processor of an information handling system an unworn profile of the cutting structure and a diamond distribution of the cutting structure. The diamond distribution may include a three-dimensional diamond distribution characterized by radial and axial position on the drill bit. The method may include calculating a final predicted wear profile of the cutting structure based, at least in part, on the unworn profile and the diamond distribution. The method also may include calculating iterations of intermediary wear profiles based, at least in part, on the previous wear profile and the diamond distribution. The final predicted wear profile may indicate a fully worn portion of the cutting structure. A usable life for the drill bit may be determined based, at least in part, on the final predicted wear profile.

20 Claims, 5 Drawing Sheets

(51) Int. Cl.
*E21B 12/02* (2006.01)
*E21B 49/00* (2006.01)

(56) References Cited

U.S. PATENT DOCUMENTS

| | | | | |
|---|---|---|---|---|
| 4,926,686 | A | 5/1990 | Fay | |
| 6,109,368 | A | 8/2000 | Goldman et al. | |
| 6,151,960 | A | 11/2000 | Taylor et al. | |
| 6,408,953 | B1 | 6/2002 | Goldman et al. | |
| 6,435,058 | B1 | 8/2002 | Matthias et al. | |
| 6,712,160 | B1 | 3/2004 | Schultz et al. | |
| 2001/0035200 | A1 | 11/2001 | Ishihara | |
| 2002/0100620 | A1 | 9/2002 | Nagasaka et al. | |
| 2003/0187582 | A1 | 10/2003 | Goldman et al. | |
| 2004/0059554 | A1 | 3/2004 | Goldman et al. | |
| 2005/0015229 | A1* | 1/2005 | Huang | G06F 30/17 703/10 |
| 2005/0096847 | A1 | 5/2005 | Huang | |
| 2005/0133272 | A1 | 6/2005 | Huang et al. | |
| 2006/0074616 | A1 | 4/2006 | Chen | |
| 2007/0032958 | A1 | 2/2007 | Chen | |
| 2007/0093996 | A1 | 4/2007 | Cariveau et al. | |
| 2008/0029308 | A1 | 2/2008 | Chen | |
| 2009/0166091 | A1 | 7/2009 | Matthews et al. | |
| 2010/0139987 | A1 | 6/2010 | Hunt et al. | |
| 2011/0035200 | A1 | 2/2011 | Huang | |
| 2019/0080034 | A1* | 3/2019 | Chen | G06F 30/20 |
| 2019/0145184 | A1* | 5/2019 | Da Silva | E21B 10/42 702/6 |

FOREIGN PATENT DOCUMENTS

| | | | |
|---|---|---|---|
| GB | 2241266 | A | 8/1991 |
| GB | 2265923 | A | 10/1993 |
| GB | 2346628 | A | 8/2000 |
| GB | 2367843 | A | 4/2002 |
| GB | 2403313 | A | 12/2004 |
| GB | 2411671 | A | 9/2005 |
| GB | 2422462 | A | 7/2006 |
| GB | 2424975 | A | 10/2006 |
| GB | 2470135 | A | 11/2010 |
| WO | 2005/008019 | | 1/2005 |
| WO | 2007/056554 | A1 | 5/2007 |

* cited by examiner

DYNAMIC WEAR PREDICTION FOR FIXED CUTTER DRILL BITS

RELATED APPLICATION

This application is a Continuation Application of U.S. patent application Ser. No. 15/027,966 filed Apr. 7, 2016, which is a U.S. National Stage Application of International Application No. PCT/US2013/069187 filed Nov. 8, 2013, which designates the United States, and which are incorporated herein by reference in their entirety.

BACKGROUND

The present disclosure relates generally to well drilling operations and, more particularly, to dynamic wear prediction for drill bits.

Hydrocarbon recovery drilling operations typically require boreholes that extend hundred and thousands of meters into the earth. The drilling operations themselves can be complex, time-consuming and expensive. One factor that adds to the expense of the drilling operation is the useable life of a drill bit used to bore the formation. Typically, when a drill bit wears out, the entire drill string must be removed from the borehole, the drill bit replaced, and then drilling re-commenced. Accordingly, the quicker a drill bit wears out, the more times the drill string must be removed, which delays the drilling progress.

FIGURES

Some specific exemplary embodiments of the disclosure may be understood by referring, in part, to the following description and the accompanying drawings.

Figure 1:
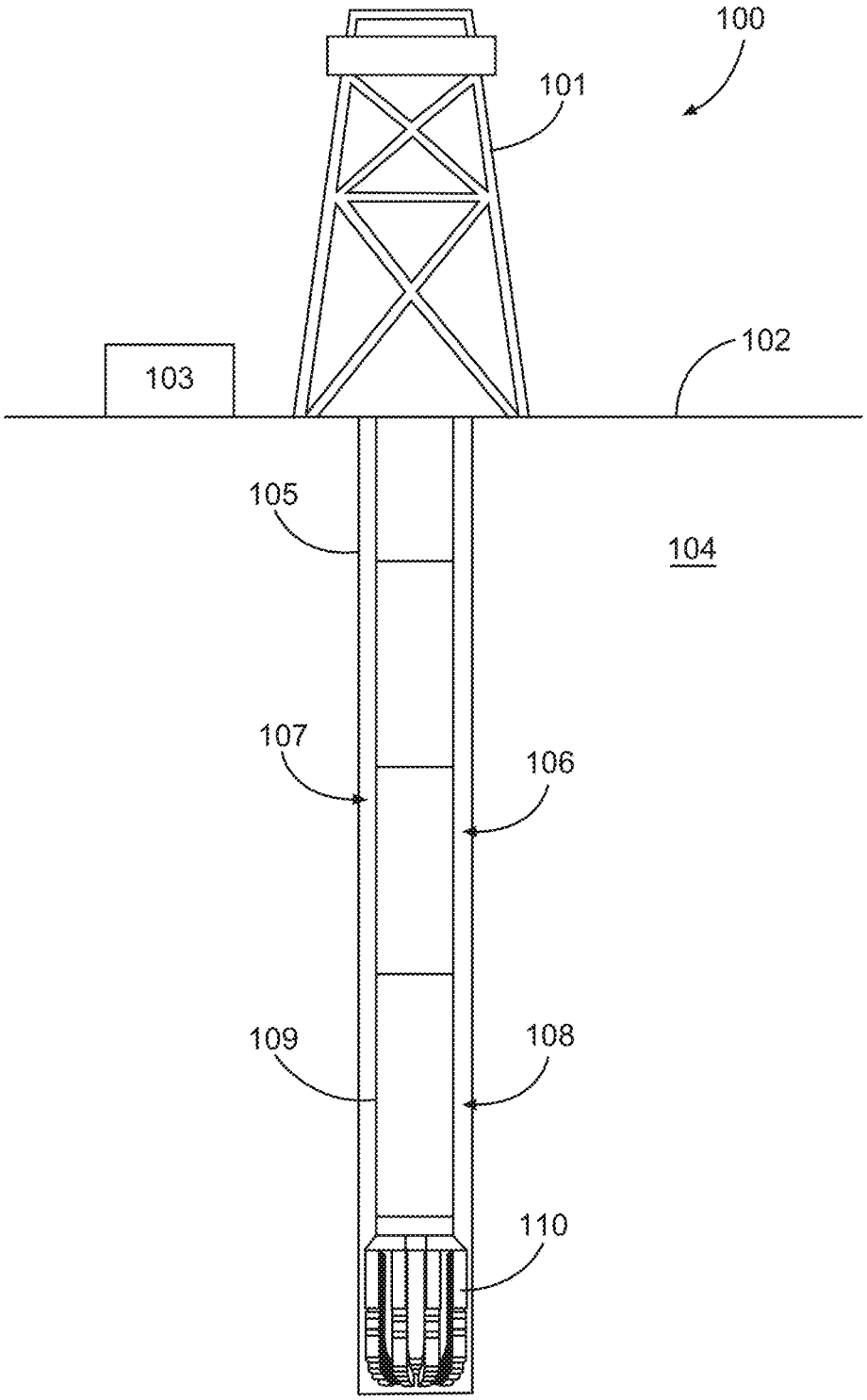
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to dynamic wear prediction for fixed cutter drill bits.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network computer, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. The processing resources may include other processors such a graphical processing units (GPU). Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

FIG. 1 shows an example drilling system 100, according to aspects of the present disclosure. The drilling system 100 includes rig 101 mounted at the surface 102 and positioned above borehole 105 within a subterranean formation 104. In the embodiment shown, a drilling assembly 106 may be positioned within the borehole 105 and may be coupled to the rig 101. The drilling assembly 106 may comprise drill string 107 and bottom hole assembly (BHA) 108. The drill string 107 may comprise a plurality of segments connected with threaded joints. The BHA 108 may comprise a drill bit 110, a measurement-while-drilling (MWD)/logging-while-drilling (LWD) section 109. The drill bit 110 may be a fixed cutter drill bit, for example, which may comprise a diamond impregnated bit with assemblies of diamond cutters and blades attached to a drill bit body. As the drilling operation is undertaken, the drill bit 110 rotates to remove portions of the formation 104 in front of it, and the friction and heat from the removal process causes the drill bit 110 to wear down. After a certain amount of wear, the drill bit 110 must be replaced, which means removing the entire drill string 107 from the borehole 105, replacing the drill bit 110, and running the drill string 107 with a new drill bit back into the borehole 105. This is costly and time consuming. Accordingly, the longer a bit can drill efficiently without being changed reduces the time and cost of drilling a well.

Figure 2:
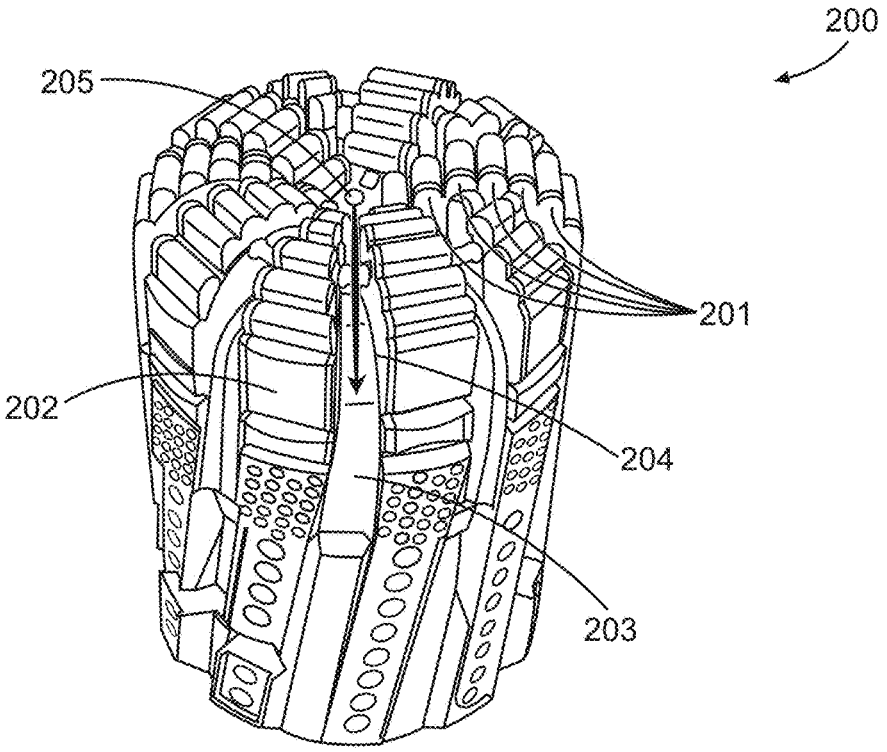
FIG. 2 is a diagram illustrating an example fixed cutter drill bit, according to aspects of the present disclosure.

FIG. 2 illustrates an example fixed cutter bit 200. The fixed cutter bit 200 comprises a body 203, at least one blade 202, and a plurality of cutters 201 disposed on the at least one blade 202 to form a cutting structure. The collective shape and orientation of the plurality of cutters 201 on the bit 200 may be referred to as a cutting profile of the bit 200. The bit body 203 may support at least one blade 202 and may, for example, be manufactured in steel or made of a metal matrix around a steel blank core. The plurality of cutters 201 may generally be at least partly made of abrasive, resistance particles, such as diamond. The abrasive particles of the plurality of cutters 201 may contact a rock formation and remove the rock as the drill bit 200 rotates. For example, the cutters 201 may be partly made of synthetic diamond powder, such as Polycrystalline Diamond Compacts or Thermally Stable Polycrystalline Diamond; natural diamonds; or synthetic diamond grains or crystals impregnated in a bond. The plurality of cutters 201 may extend outward in a radial direction 204 from a longitudinal axis 205 of the drill bit.

The useable life of the fixed cutter bit 200 depends, in part, on the distribution of diamonds on the bit 200 compared to the amount of rock the bit 200 will remove. Within the context of this disclosure, as will be discussed below, a radial zone of the bit cutting structure may be characterized as "weak" if the radial zone does not have a sufficiently quantity of diamond compared to the amount of rock to be removed at that radial position. As will be appreciated by one of ordinary skill in the art in view of this disclosure, once a radial zone of the bit has been fully worn down, the bit must be removed from the borehole, even if the remainder of the bit has available diamond.

According to aspects of the present disclosure, drill bit design systems and methods disclosed herein may be used to determine a useable life of a drill bit design by modeling bit wear over time. The system and methods may provide multiple "snap-shots" of the cutting profile over time or distance, allowing a designer to determine how the drill bit is wearing down and how the distribution of diamonds should be changed to avoid weak radial zones. The "snap-shots" of the cutting profile over time or distance may be referred to herein as predicted wear profiles. Likewise, the original cutting profile of an unused bit may be referred to herein as an unworn profile.

The predicted wear profiles may be generated for a variety of different drill bit designs and diamond distributions to maximize the useable diamond and the life of the drill bit. The predicted wear profiles may comprise graphical, two or three-dimensional representations that may be generated within an information handling system with a processor and at least one memory device. The memory device may contain instructions that, when executed, cause the processor to generate predicted wear profiles based on certain conditions. The set of instructions may be included as part of existing software or modeling programs. For example, predicted wear profiles may be generated as part of design conception software, including CAD software, and may allow for the validity of a cutting structure design to be ensured.

Figure 3:
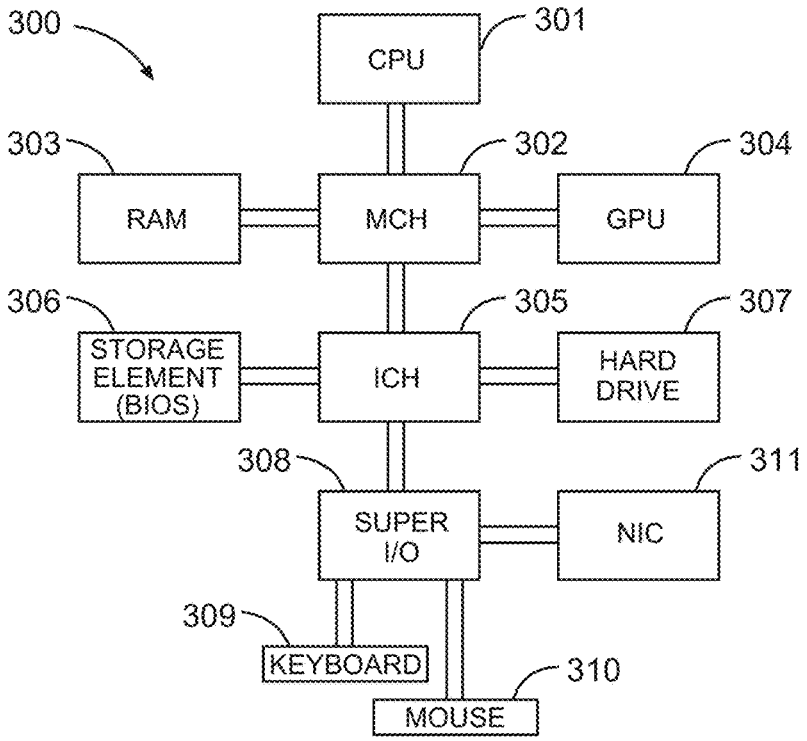
FIG. 3 is a diagram illustrating an example information handling system, according to aspects of the present disclosure.

Shown in FIG. 3 is a block diagram of an example information handling system 300. A processor or CPU 301 of the information handling system 300 may be communicatively coupled to a memory controller hub or north bridge 302. The memory controller hub 302 may be coupled to RAM 303 and a graphics processing unit 304. Memory controller hub 302 may also be coupled to an I/O controller hub or south bridge 305. I/O hub 305 may be coupled to storage elements of the computer system, including a storage element 306, which may comprise a flash ROM that includes the basic input/output system (BIOS) of the computer system. I/O hub 305 is also coupled to the hard drive 307 of the computer system. The hard drive 307 may be characterized as a tangible computer readable medium that contains a set of instructions that, when executed by the processor 301, causes the information handling system 300 to perform a pre-determined set of operations. For example, according to certain embodiments of the present disclosure, and as will be discussed below, the hard drive 307 may contain instructions that when executed cause the CPU 301 to model a drill bit, according to aspects of the present disclosure, and generate wear representations related to a particular bit design.

In certain embodiments, I/O hub 305 may also be coupled to a super I/O chip 308, which is itself coupled to several of the I/O ports of the computer system, including keyboard 309, mouse 310, and one or more parallel ports. The super I/O chip 308 may further be coupled to a network interface card (NIC) 311. The information handling system 300 may receive measurements or logs various over the NIC 311, for processing or storage on a local storage device, such as hard drive 307. In certain embodiments, the data may be stored in a dedicated mass storage device (not shown). The information handling system may then retrieve data from the dedicated storage device, and perform computations on the data using algorithms stored locally within hard drive 307.

Figure 4:
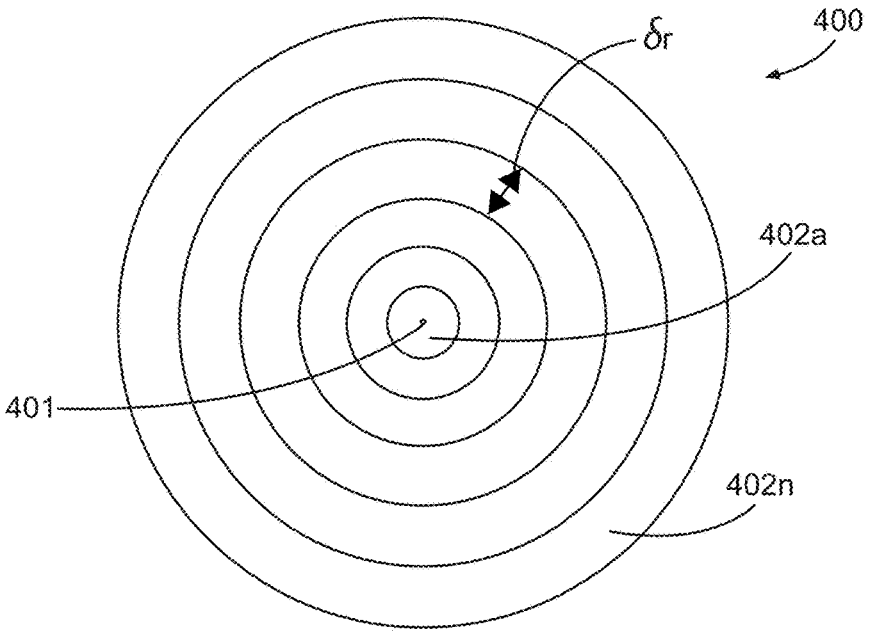
FIG. 4 is a diagram illustrating a typical two-dimensional model of a radially subdivided drill bit cutting structure.
Figure 5:
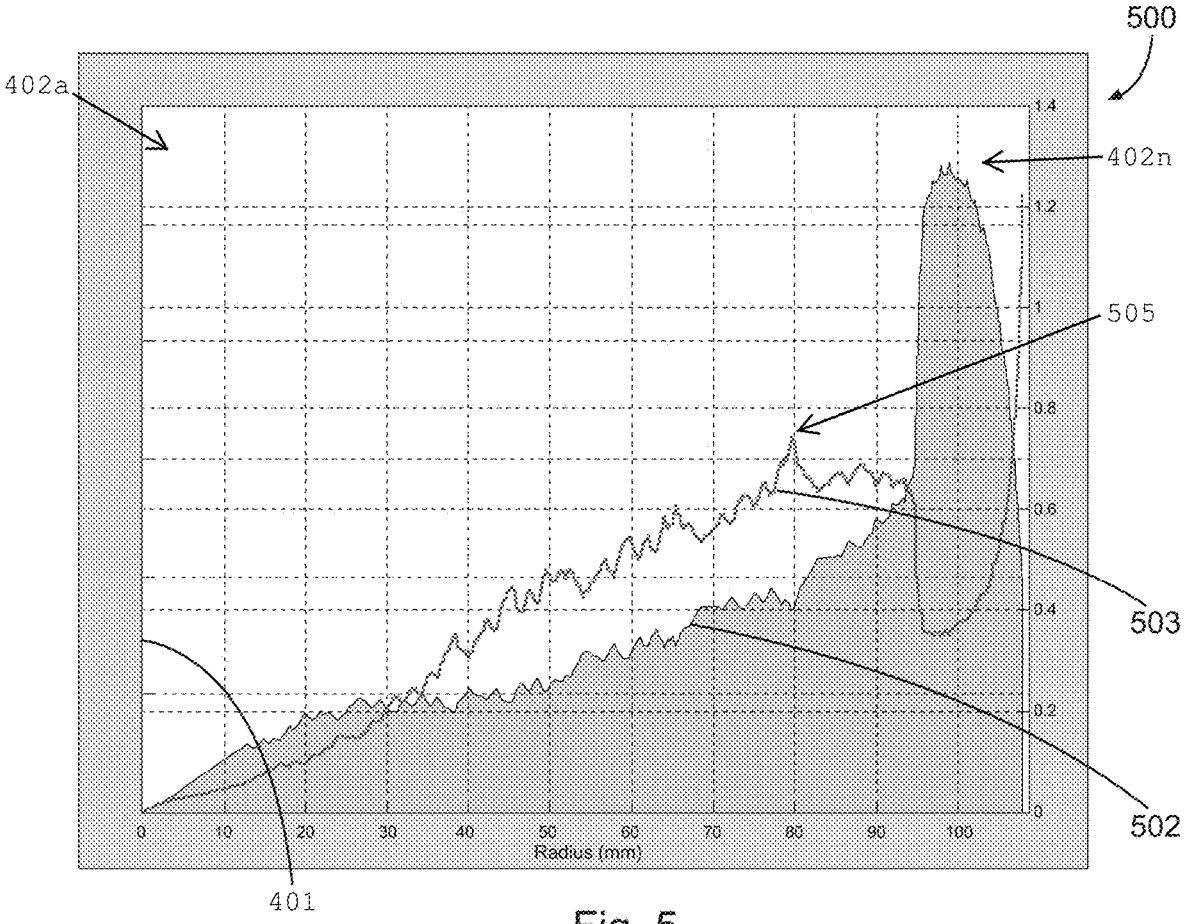
FIG. 5 is a diagram illustrating a typical diamond radial distribution graph and predicted relative wear rate graph.

FIG. 4 is a diagram illustrating a typical two-dimensional model of a radially divided drill bit cutting structure with rings of infinitesimal width. Specifically, FIG. 4 illustrates an existing drill bit model that divides a cutting structure of a drill bit 400 into rings 402*a-n* of infinitesimal width, $\delta$ r (shown with finite width for illustrative purposes), that are coaxial with the longitudinal axis 401 of the drill bit 400, and determines a diamond radial distribution of the total diamond volume within each of the rings 402*a-n*. These diamond volumes are then compared with a total amount of rock to be removed at the corresponding radial position during the life of the drill bit to determine an average relative wear rate curve for the drill bit. FIG. 5 illustrates an example average relative wear rate curve 503 plotted as a function of radius. FIG. 5 also illustrates an example two-dimensional diamond radial distribution 502, plotting the diamond volume found in each infinitesimal ring 402*a-n* versus the radial distance of the ring from a longitudinal bit axis 401. Any peaks in the average relative wear rate curve 503, such as peak 505, may identify weak zones in the drill bit.

Although the two-dimensional model and average relative wear rate curve identify weak areas, they do not account for variations in the wear rate that occur due to changes in the cutting structure of a drill bit. These changes may be cause by local cutting conditions at each of the radial areas as a function of time or meterage drilled, and may lead to inaccuracies in the identification of weak zones. According to aspects of the present disclosure, a three-dimensional model of a cutting structure may be used to model the local cutting conditions and calculate wear profiles for the cutting structure over time or meterage drilled.

Figure 6:
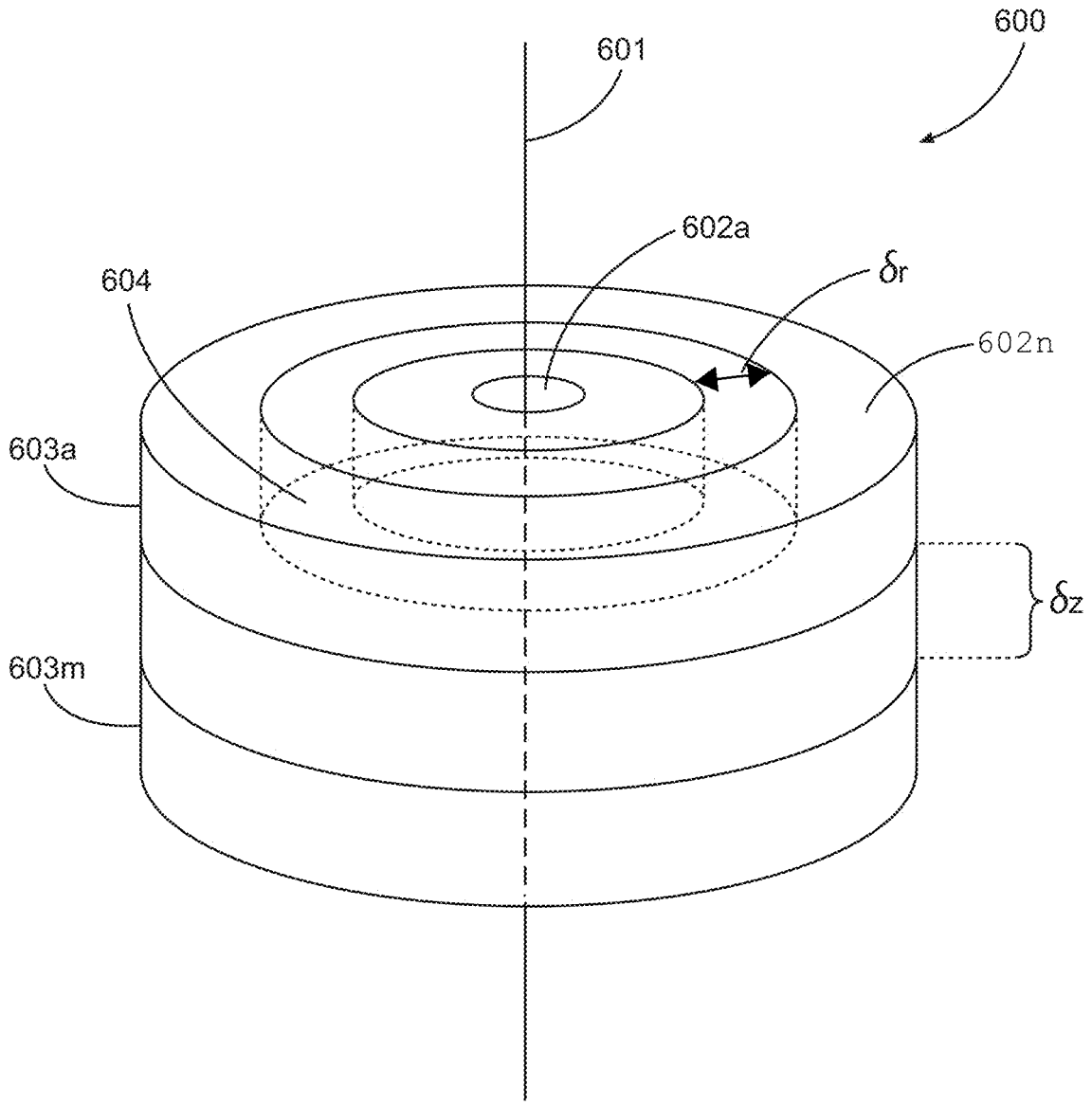
FIG. 6 is a diagram illustrating an example three-dimensional schematic model of a radially and axially subdivided drill bit cutting structure, according to aspects of the present disclosure.

FIG. 6 is a diagram illustrating an example three-dimensional schematic model 600 of a radially and axially subdivided drill bit cutting structure, according to aspects of the present disclosure. As will be described below, the model 600 may be used to provide a radial and axial diamond distribution for a drill bit, which may be used to calculate predicted wear profiles over time or distance. Drill bit 600 is divided into rings 602*a-n* of infinitesimal width δ r (shown with finite width for illustrative purposes) that are coaxial with the longitudinal axis 601 of the drill bit 600. As can also be seen, drill bit 600 is also divided into layers 603*a-m* of infinitesimal thicknesses δ z (shown with finite thickness for illustrative purposes) that are perpendicular to the longitudinal axis 601 of the drill bit 600. This results in three-dimensional infinitesimal ring volumes δ r.δ z 604 with rectangular section geometries. Notably, each of the volumes in the elements δ r.δ z may correspond to a particular volume of diamond that is part of the cutting structure of the drill bit 600, and each may be characterized by their radial and axial locations on the cutting structure. Although FIG. 6 shows a simplified model of three-dimensions diamond distribution through a spatial division into cylindrical and concentric rings for demonstration purposes, other more complex geometries are possible.

Time-based snap shots of the cutting profile can be determined by identifying the diamond volumes within thickness layers instead of the over the entire thickness of the drill bit 600, as can the effects of local cutting conditions—including, for example, the depth of cut—on the drill bit 600. At any given time, only the diamond volume in an infinitesimal layer at a cutting profile of the cutting structure is in contact with the rock. In certain embodiments, that diamond volume can be determined by dividing the infinitesimal layer into a plurality of ring volumes with rectangular shape, similar to those in FIG. 6, and calculating the diamond within the ring volumes using the three-dimensional diamond distribution. This calculated diamond volume may be referred to as a diamond volume radial distribution. Once the diamond volume radial distribution is determined, it can be compared to a rock radial distribution, corresponding to a radial distribution of the rock amount to be removed by the ring volumes in given period of time or meterage drilled. A wear rate for the given period of time or meterage drilled may be calculated by comparing the diamond volume radial distribution to the rock radial distribution. The calculated wear rate and identified local conditions can then be used to calculate a new cutting profile. The new cutting profile then may be used to calculate a new diamond volume radial distribution, which can then be compared to a new rock radial distribution to find a new wear rate, etc. This process may continue iteratively, until a final wear profile is reached. The final wear profile may identify when an area of the drill bit no longer contains diamond.

An example iterative process may begin with a new drill bit design having a cutting structure with an unworn cutting profile. A first diamond volume radial distribution at the unworn profile may be determined using a three-dimensional diamond distribution of the cutting structure. In certain embodiments, the process may include calculating a first rock radial distribution of a rock amount to be removed by the drill bit during a first duration of use of or meterage drilled with the drill bit. In certain embodiments, the first rock radial distribution may be compared to the first diamond volume radial distribution to determine a first wear rate during the first duration of use of or meterage drilled with the drill bit. A first predicted wear profile may be determined using the first wear rate and the unworn profile.

Using a similar process, the first predicted wear profile may be used to calculate a second diamond volume radial distribution, which may be compared to a second rock radial distribution to determine a second wear rate that then is used to calculate a second predicted wear profile. Eventually, a final predicted wear profile may be determined in which an area of the drill bit may no longer contain diamond. In certain embodiments, the predicted wear profiles between the unworn profile and the final predicted wear profiles may be referred to as a predicted intermediate wear profiles. Notably, by adding up the durations of use or meterages drilled used to calculate the previous wear profiles, a useable life of the drill bit design may be calculated.

Figure 7:
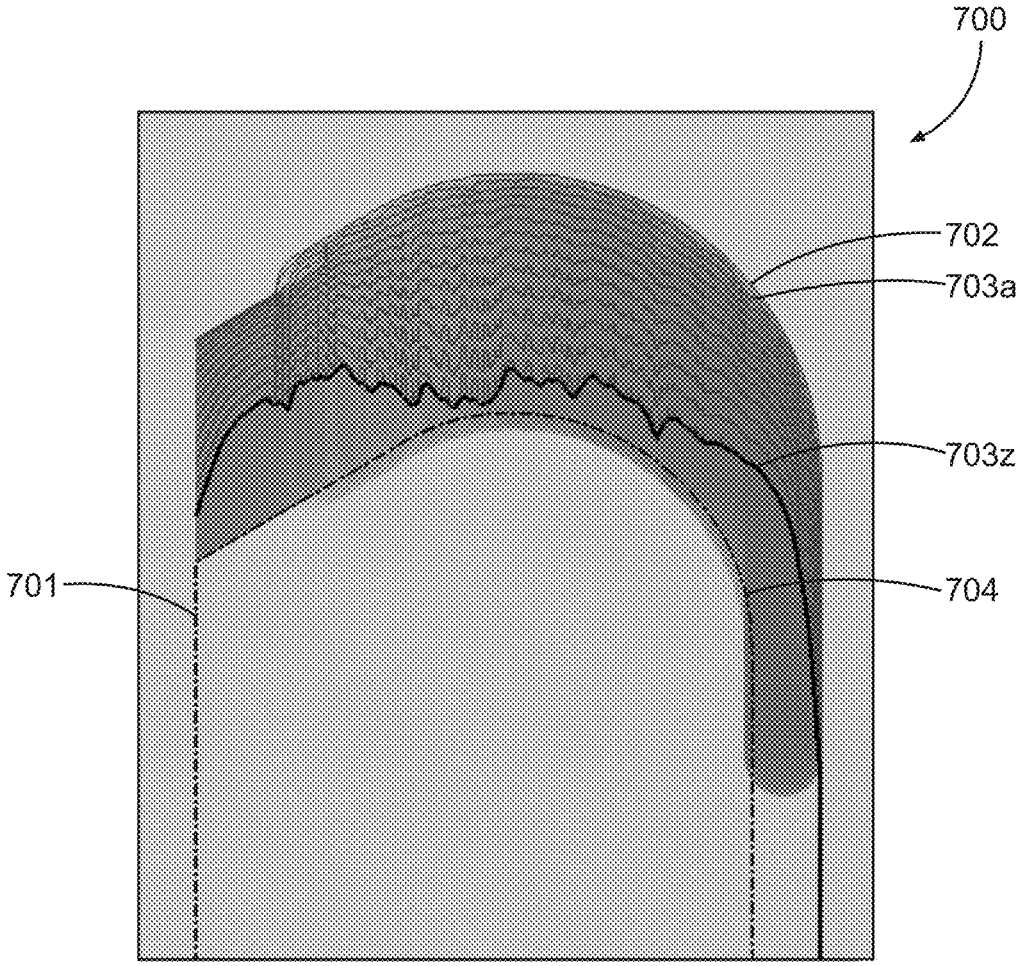
FIG. 7 is a diagram illustrating an example iterative progression of predicted wear profiles, according to aspects of the present disclosure.

FIG. 7 is a diagram illustrating an example iterative progression of predicted wear profiles 703*a-z*, according to aspects of the present disclosure. As described above, the progression of predicted wear profiles may account for the amount of rock to cut and the diamond distribution of the drill bit, and may identify the predicted wear profiles for the bit at given points in time or meterage drilled. As is also described above, the predicted wear profiles in FIG. 7 may be calculated following an iterative process where each wear profile 703*z* is calculated from the preceding calculated wear profile 703*z*−1, such that each wear profile is based, at least in part, on each of the preceding calculated wear profiles.

The predicted wear profiles 703*a-z* are plotted in terms of radial distance from and axial location relative to the longitudinal axis 701 of the bit. In the embodiment shown, the first wear profile 703*a* comprises an unworn profile of a cutting structure in a drill bit design. Wear profile 703*z* comprises a final predicted wear profile, in which a portion of the wear profile reaches the bit body profile 704, indicating the portion no longer contains diamond. When, at any radial position, the predicted wear profile reaches the bit body profile 704, that predicted wear profile is considered the final predicated wear profile and the cutting structure is then considered fully worn.

In certain embodiments, at least one wear profile, such as the final predicted wear profile, may be displayed to a user. Other profiles, such as the unworn profile and the intermediate wear profiles may also be displayed to a user. By modeling and displaying the wear profiles as they evolve over time, the diamond distribution on the fixed cutter bit can be optimized to eliminate or reduce weak spots that cause the uneven wear patterns, increasing bit life. In certain embodiments, the three-dimensional diamond distribution may be displayed as at least one of a two or three-dimensions graph and/or a numerical table. This may allow a designer to dynamically modify the diamond distribution upon viewing the calculated and displayed wear profiles.

According to aspects of the present disclosure, an example method for dynamic wear prediction for a drill bit with a cutting structure may comprise receiving at a processor of an information handling system an unworn profile of the cutting structure and a diamond distribution of the cutting structure. The diamond distribution may comprise a three-dimensional diamond distribution characterized by radial and axial position on the drill bit. The method may include calculating a final predicted wear profile of the cutting structure based, at least in part, on the unworn profile and the diamond distribution. The final predicted wear profile may indicate a fully worn portion of the cutting structure. A usable life for the drill bit may be determined based, at least in part, on the final predicted wear profile.

In certain embodiments, the final predicted wear profile may correspond to a final predicted duration of use of the drill bit or meterage drilled with the drill bit. Determining the usable life for the drill bit based, at least in part, on the final predicted wear profile may comprise determining the usable life for the drill bit using the final predicted duration of use of the drill bit or meterage drilled with the drill bit. In certain embodiments, the method may include displaying the final predicted wear profile on a display communicably coupled to the processor.

Receiving at the processor the diamond distribution of the cutting structure may comprise calculating the diamond distribution by dividing the cutting structure into a plurality of infinitesimal ring volumes, and characterizing each ring volume by its radial and axial location on the cutting structure and its diamond volume. In certain embodiments, calculating the final predicted wear profile of the cutting structure based, at least in part, on the unworn profile and the diamond distribution may comprise calculating a first predicted intermediate wear profile based, at least on part, on the unworn profile and the diamond distribution. The first predicted intermediate wear profile may correspond to a first duration of use of the drill bit or meterage drilled with the drill bit. Calculating the final predicted wear profile of the cutting structure based, at least in part, on the unworn profile and the diamond distribution may also comprise calculating the final predicted wear profile based, at least in part, on the first predicted intermediate wear profile. In certain embodiments, calculating the first predicted intermediate wear profile based, at least on part, on the unworn profile and the diamond distribution may comprise calculating a first diamond volume radial distribution in a first infinitesimal layer at the unworn profile using the plurality of infinitesimal ring volumes, calculating a first rock radial distribution of a rock amount to be removed by the drill bit during the first duration of use of the drill bit or meterage drilled with the drill bit, and calculating the first predicted intermediate wear profile by comparing the first diamond volume radial distribution to the first rock radial distribution.

In certain embodiments, calculating the final predicted wear profile of the cutting structure based, at least in part, on the unworn profile and the diamond distribution may comprise calculating a second predicted intermediate wear profile based, at least on part, on the first predicted intermediate wear profile. The second predicted intermediate wear profile may correspond to a second duration of use of the drill bit or meterage drilled with the drill bit. Calculating the final predicted wear profile of the cutting structure based, at least in part, on the unworn profile and the diamond distribution may also comprise calculating the final predicted wear based, at least in part, on the second predicted intermediate wear profile. In certain embodiments, calculating the second predicted intermediate wear profile based, at least on part, on the first predicted intermediate wear profile may comprise calculating a second diamond volume radial distribution in a second infinitesimal layer at the first predicted intermediate wear profile using the plurality of infinitesimal ring volumes, calculating a second rock radial distribution of a rock amount to be removed by the drill bit during the second duration of use of the drill bit or meterage drilled with the drill bit, and calculating the second predicted intermediate wear profile by comparing the second diamond volume radial distribution to the second rock radial distribution.

In certain embodiments, the method may comprise displaying at least one of the unworn profile, the first predicted intermediate wear profile, and second predicted intermediate wear profile on the display. At least part of the diamond distribution may also be displayed as at least one of a two or three-dimensions graph and/or a numerical table.

According to aspects of the present disclosure, an example system for dynamic wear prediction for a drill bit with a cutting structure may include a processor and a memory device coupled to the processor. The memory device may include a set of instructions that, when executed by the processor, causes the processor to receive an unworn profile of the cutting structure and a diamond distribution of the cutting structure; calculate a final predicted wear profile of the cutting structure based, at least in part, on the unworn profile and the diamond distribution; and determine a usable life for the drill bit based, at least in part, on the final predicted wear profile. The final predicted wear profile may indicate a fully worn portion of the cutting structure In certain embodiments, the final predicted wear profile may correspond to a final predicted duration of use of the drill bit or meterage drilled with the drill bit. The set of instructions that cause the processor to determine the usable life for the drill bit based, at least in part, on the final predicted wear profile may further cause the processor to determine the usable life for the drill bit using the final predicted duration of use of the drill bit or meterage drilled with the drill bit. In certain embodiments, the system may include a display communicably coupled to the processor. The set of instructions further cause the processor to display the final predicted wear profile on the display.

The set of instructions that cause the processor to receive at the processor the diamond distribution of the cutting structure may further cause the processor to divide the cutting structure into a plurality of infinitesimal ring volumes, and characterize each ring volume by its radial and axial location on the cutting structure and its diamond volume. The set of instructions that cause the processor to calculate the final predicted wear profile of the cutting structure based, at least in part, on the unworn profile and the diamond distribution may further cause the processor to calculate a first predicted intermediate wear profile based, at least on part, on the unworn profile and the diamond distribution, and calculate the final predicted wear profile based, at least in part, on the first predicted intermediate wear profile. The first predicted intermediate wear profile may correspond to a first duration of use of the drill bit or meterage drilled with the drill bit. The set of instructions that cause the processor to calculate the first predicted intermediate wear profile based, at least on part, on the unworn profile and the diamond distribution may further cause the processor to calculate a first diamond volume radial distribution in a first infinitesimal layer at the unworn profile using the plurality of infinitesimal ring volumes, calculate a first rock radial distribution of a rock amount to be removed by the drill bit during the first duration of use of the drill bit or meterage drilled with the drill bit, and calculate the first predicted intermediate wear profile by comparing the first diamond volume radial distribution to the first rock radial distribution.

In certain embodiments, the set of instructions that cause the processor to calculate the final predicted wear profile of the cutting structure based, at least in part, on the unworn profile and the diamond distribution may further cause the processor to calculate a second predicted intermediate wear profile based, at least on part, on the first predicted intermediate wear profile, and calculate the final predicted wear based, at least in part, on the second predicted intermediate wear profile. The second predicted intermediate wear profile may correspond to a second duration of use of the drill bit or meterage drilled with the drill bit. The set of instructions that cause the processor to calculate the second predicted intermediate wear profile based, at least on part, on the first predicted intermediate wear profile may further cause the processor to calculate a second diamond volume radial distribution in a second infinitesimal layer at the first predicted intermediate wear profile using the plurality of infinitesimal ring volumes, calculate a second rock radial distribution of a rock amount to be removed by the drill bit during the second duration of use of the drill bit or meterage drilled with the drill bit, and calculate the second predicted intermediate wear profile by comparing the second diamond volume radial distribution to the second rock radial distribution.

In certain embodiments, the set of instructions may further cause the processor to display at least one of the unworn profile, the first predicted intermediate wear profile, and second predicted intermediate wear profile on the display. The set of instructions may further cause the processor to display at least part of the diamond distribution as at least one of a two or three-dimensions graph and/or a numerical table Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for designing a drill bit, comprising:

receiving, at a processor:

data representing an unworn profile of a first cutting structure of a first physical drill bit; and data representing an initial distribution of diamond material on the first cutting structure in accordance with an initial drill bit design;

calculating a final predicted wear profile of the first cutting structure based on the unworn profile and the initial distribution of the diamond material, the final predicted wear profile indicating a portion of the first cutting structure in which the diamond material is fully worn down;

determining a usable life for the first physical drill bit based on the final predicted wear profile of the first cutting structure, the determined usable life representing a duration of use of the first physical drill bit or a meterage drilled with the first physical drill bit prior to the diamond material in the indicted portion of the first cutting structure becoming fully worn down;

generating a modified distribution of diamond material for a second cutting structure based on the determined usable life for the first physical drill bit; and generating a modified drill bit design including the modified distribution of diamond material for the second cutting structure that, when used to manufacture a second physical drill bit including the second cutting structure, causes the second physical drill bit to have a bit life greater than the determined usable life for the first physical drill bit.

2. The method of claim 1, further comprising calculating the initial distribution of diamond material on the first cutting structure in accordance with the initial drill bit design.

3. The method of claim 2, wherein calculating the initial distribution of diamond material on the first cutting structure comprises:

dividing a representation of the first cutting structure into a plurality of infinitesimal ring volumes; and characterizing each ring volume by its respective radial and axial locations on the first cutting structure and its respective diamond volume.

4. The method of claim 1, wherein calculating the final predicted wear profile of the first cutting structure comprises:

calculating a first predicted intermediate wear profile of the first cutting structure based on the unworn profile and the initial distribution of the diamond material, the first predicted intermediate wear profile corresponding to a first duration of use of the first physical drill bit or a first meterage drilled with the first physical drill bit; and calculating the final predicted wear profile based on the first predicted intermediate wear profile of the first cutting structure.

5. The method of claim 4, wherein calculating the first predicted intermediate wear profile comprises:

calculating a first diamond volume radial distribution in a first infinitesimal layer at the unworn profile using the plurality of infinitesimal ring volumes;

calculating a first rock radial distribution of a rock amount to be removed by the first physical drill bit during the first duration of use of the first physical drill bit or as the first meterage drilled with the first physical drill bit; and comparing the first diamond volume radial distribution to the first rock radial distribution.

6. The method of claim 4, wherein calculating the final predicted wear profile of the first cutting structure further comprises:

calculating a second predicted intermediate wear profile based on the first predicted intermediate wear profile, the second predicted intermediate wear profile corresponding to a second duration of use of the first physical drill bit or a second meterage drilled with the first physical drill bit; and calculating the final predicted wear further based on the second predicted intermediate wear profile.

7. The method of claim 6, wherein calculating the second predicted intermediate wear profile comprises:

calculating a second diamond volume radial distribution in a second infinitesimal layer at the first predicted intermediate wear profile using the plurality of infinitesimal ring volumes;

calculating a second rock radial distribution of a rock amount to be removed by the first physical drill bit during the second duration of use of the first physical drill bit or as the second meterage drilled with the first physical drill bit; and comparing the second diamond volume radial distribution to the second rock radial distribution.

8. The method of claim 6, further comprising displaying a representation of at least one of the unworn profile, the first predicted intermediate wear profile, and the second predicted intermediate wear profile on a display communicably coupled to the processor.

9. The method of claim 1, further comprising displaying a representation of the final predicted wear profile on a display communicably coupled to the processor.

10. The method of claim 1, further comprising displaying, on a display communicably coupled to the processor, at least a portion of the data representing the initial distribution of diamond material on the first cutting structure in a two-dimensional graph, a three-dimensional graph, or a numerical table.

11. A system for designing a drill bit, comprising:

a processor; and a memory coupled to the processor, the memory comprising instructions that, when executed by the processor, cause the processor to:

receive data representing an unworn profile of a first cutting structure of a first physical drill bit;

receive data representing an initial distribution of diamond material on the first cutting structure in accordance with an initial drill bit design;

calculate a final predicted wear profile of the first cutting structure based on the unworn profile and the initial distribution of the diamond material, the final predicted wear profile indicating a portion of the first cutting structure in which the diamond material is fully worn down;

determine a usable life for the first physical drill bit based on the final predicted wear profile of the first cutting structure, the determined usable life representing a duration of use of the first physical drill bit or a meterage drilled with the first physical drill bit prior to the diamond material in the indicated portion of the first cutting structure becoming fully worn down;

generate a modified distribution of diamond material for a second cutting structure based on the determined usable life for the first physical drill bit; and generate a modified drill bit design including the modified distribution of diamond material for the second cutting structure that, when used to manufacture a second physical drill bit including the second cutting structure, causes the second physical drill bit to have a bit life greater than the determined usable life for the first physical drill bit.

12. The system of claim 11, wherein when executed by the processor, the instructions further cause the processor to calculate the initial distribution of diamond material on the first cutting structure in accordance with the initial drill bit design.

13. The system of claim 12, wherein to calculate the initial distribution of diamond material on the first cutting structure, the instructions cause the processor to:

divide a representation of the first cutting structure into a plurality of infinitesimal ring volumes; and characterize each ring volume by its respective radial and axial locations on the first cutting structure and its respective diamond volume.

14. The system of claim 11, wherein to calculate the final predicted wear profile of the first cutting structure, the instructions cause the processor to:

calculate a first predicted intermediate wear profile of the first cutting structure based on the unworn profile and the initial distribution of the diamond material, the first predicted intermediate wear profile corresponding to a first duration of use of the first physical drill bit or a first meterage drilled with the first physical drill bit; and calculate the final predicted wear profile based on the first predicted intermediate wear profile of the first cutting structure.

15. The system of claim 14, wherein to calculate the first predicted intermediate wear profile, the instructions cause the processor to:

calculate a first diamond volume radial distribution in a first infinitesimal layer at the unworn profile using the plurality of infinitesimal ring volumes;

calculate a first rock radial distribution of a rock amount to be removed by the first physical drill bit during the first duration of use of the first physical drill bit or as the first meterage drilled with the first physical drill bit; and compare the first diamond volume radial distribution to the first rock radial distribution.

16. The system of claim 14, wherein to calculate the final predicted wear profile of the first cutting structure, the instructions further cause the processor to:

calculate a second predicted intermediate wear profile based on the first predicted intermediate wear profile, the second predicted intermediate wear profile corresponding to a second duration of use of the first physical drill bit or a second meterage drilled with the first physical drill bit; and calculate the final predicted wear further based on the second predicted intermediate wear profile.

17. The system of claim 16, wherein to calculate the second predicted intermediate wear profile, the instructions cause the processor to:

calculate a second diamond volume radial distribution in a second infinitesimal layer at the first predicted intermediate wear profile using the plurality of infinitesimal ring volumes;

calculate a second rock radial distribution of a rock amount to be removed by the first physical drill bit during the second duration of use of the first physical drill bit or as the second meterage drilled with the first physical drill bit; and compare the second diamond volume radial distribution to the second rock radial distribution.

18. The system of claim 16, further comprising a display communicably coupled to the processor, wherein the instructions further cause the processor to display a representation of at least one of the unworn profile, the first predicted intermediate wear profile, and the second predicted intermediate wear profile on the display.

19. The system of claim 11, further comprising a display communicably coupled to the processor, wherein the instructions further cause the processor to display a representation of the final predicted wear profile on the display.

20. The system of claim 11, further comprising a display communicably coupled to the processor, wherein the instructions further cause the processor to display at least a portion of the data representing the initial distribution of diamond material on the first cutting structure on the display in a two-dimensional graph, a three-dimensional graph, or a numerical table.

* * * * *